US009198549B1

(12) United States Patent
Ajello

(10) Patent No.: US 9,198,549 B1
(45) Date of Patent: Dec. 1, 2015

(54) REVERSIBLE UNI-HINGE FOR USE WITH A TOILET PARTITION DOOR AND ASSOCIATED METHOD

(71) Applicant: Mike Ajello, Santa Ana, CA (US)

(72) Inventor: Mike Ajello, Santa Ana, CA (US)

( * ) Notice: Subject to any disclaimer, the term of this patent is extended or adjusted under 35 U.S.C. 154(b) by 17 days.

(21) Appl. No.: 14/248,173

(22) Filed: Apr. 8, 2014

Related U.S. Application Data

(60) Provisional application No. 61/847,252, filed on Jul. 17, 2013.

(51) Int. Cl.
*E05F 1/02* (2006.01)
*A47K 13/12* (2006.01)

(52) U.S. Cl.
CPC ..... *A47K 13/12* (2013.01)

(58) Field of Classification Search
CPC ..... E05Y 2900/14; E05Y 2900/142; E05Y 2900/40; E05Y 2900/112; E05Y 2900/114; E05Y 2201/638; E05Y 2600/502; E05F 1/063; E05F 1/061; E05F 1/043; E05F 1/068; E05D 5/00; E05D 5/02; E05D 5/0264; E05D 5/06; Y10T 16/539; Y10T 16/5395; Y10T 16/5398; Y10T 16/558; Y10T 16/5595; Y10T 16/55963; Y10T 16/534
See application file for complete search history.

(56) References Cited

U.S. PATENT DOCUMENTS

| | | | | | |
|---|---|---|---|---|---|
| 2,268,669 | A | * | 1/1942 | Moore | 160/229.1 |
| 2,644,258 | A | * | 7/1953 | Gillette | 49/247 |
| 3,044,107 | A | * | 7/1962 | Tansey | 16/303 |
| 3,134,134 | A | * | 5/1964 | McCubbin | 16/263 |
| 3,153,807 | A | * | 10/1964 | Nyman | 16/390 |
| 3,171,157 | A | * | 3/1965 | Loughlin | 16/390 |
| 3,351,402 | A | * | 11/1967 | Barecki et al. | 312/233 |
| 3,545,031 | A | * | 12/1970 | Dielman | 16/263 |
| 3,545,032 | A | * | 12/1970 | Dielman | 16/263 |
| D265,048 | S | * | 6/1982 | Guardia | D8/328 |
| 4,502,183 | A | * | 3/1985 | Clancy, Jr. | 16/318 |
| 4,949,997 | A | * | 8/1990 | Champagne | 281/45 |
| 5,172,519 | A | * | 12/1992 | Cooper | 49/400 |
| 5,199,218 | A | * | 4/1993 | McQuade | 49/381 |
| 5,448,799 | A | * | 9/1995 | Stein, Jr. | 16/225 |
| 5,463,795 | A | * | 11/1995 | Carlson et al. | 16/273 |
| D372,852 | S | * | 8/1996 | Noll et al. | D8/328 |
| 5,592,787 | A | * | 1/1997 | Ophardt | 52/34 |
| 6,173,475 | B1 | * | 1/2001 | Senn et al. | 16/273 |
| 6,389,644 | B1 | * | 5/2002 | Russo | 16/382 |
| D557,586 | S | * | 12/2007 | Shire et al. | D8/327 |
| 2004/0231106 | A1 | * | 11/2004 | Shire | 16/390 |
| 2006/0090297 | A1 | * | 5/2006 | Chue | 16/312 |
| 2006/0242792 | A1 | * | 11/2006 | Kienle | 16/252 |
| 2011/0088217 | A1 | * | 4/2011 | Bjorn et al. | 16/235 |
| 2013/0067689 | A1 | * | 3/2013 | Mitchell et al. | 16/382 |

FOREIGN PATENT DOCUMENTS

| | | | | |
|---|---|---|---|---|
| JP | 2000120322 | A | * | 4/2000 |
| JP | 2001123735 | A | * | 5/2001 |

* cited by examiner

*Primary Examiner* — Chuck Mah

(57) ABSTRACT

A reversible uni-hinge includes a hinge assembly having a fulcrum axis passing through a longitudinal length thereof, a static first channel operably coupled to the hinge assembly, and a dynamic second channel operably coupled to the hinge assembly. Notably, the hinge assembly is connected to an exterior side of each of the static first channel and the dynamic second channel in such a manner that the dynamic second channel linearly reciprocates along the fulcrum axis as well as rotates in clockwise and counter clockwise directions about the fulcrum axis.

5 Claims, 14 Drawing Sheets

REVERSIBLE UNI-HINGE FOR USE WITH A TOILET PARTITION DOOR AND ASSOCIATED METHOD

CROSS REFERENCE TO RELATED APPLICATIONS

This application claims the benefit of U.S. Provisional Application No. 61/847,252 filed Jul. 17, 2013, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

Exemplary embodiment(s) of the present disclosure relate to door hinges and, more particularly, to a reversible uni-hinge including a gravity cam that is used to pivotally connect a toilet door partition to an existing pilaster.

2. Prior Art

Cubicle compartments, as generally used to divide interior building space into separate rooms such as hospital and toilet cubicles, are generally composed of two or more spaced posts or pilasters between which a door is swingably mounted, and having spaced dividing partitions extending between a vertical wall of the building and the respective pilasters. The dividing partitions and door bodies are usually limited in thickness to approximately one inch to conserve space, and the doorframe defining pilasters are also preferably limited to a thickness of not substantially more and preferably less than one and one-half inches. To insure maximum sanitation, and to facilitate cleaning of the wall surfaces, the door supporting hinge brackets as well as door stop brackets are preferably confined to the jamb edges of the doorframe defining pilasters, and so that no part of the hinge brackets or door stop brackets overlap the side wall forming faces of the pilasters.

The relatively thin doorframe forming pilasters have heretofore been assembled from a pair of side wall facing pans which are separately shaped and notched and then assembled together to provide a pilaster body whose vertical edges are covered by semi-tubular edging strips which are telescoped over and interlock with outwardly flared lip portions extending from the vertical edges of the pilaster body. Hinge brackets and/or a door stop bracket can then be locked in mounted position on the jamb edges of the pilaster body by providing a tongue which projects from one or both ends of the hinge bracket or door stop bracket, and which interlocks with the semi-tubular edging strip which is telescoped thereover.

Accordingly, a need remains for a uni-hinge in order to overcome at least one prior art shortcoming. The exemplary embodiment(s) satisfy such a need by providing a reversible uni-hinge including a gravity cam that is convenient and easy to use, lightweight yet durable in design, versatile in its applications, and designed to pivotally connect a toilet door partition to an existing pilaster.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a reversible uni-hinge for pivotally connecting an existing toilet door partition to an existing pilaster. These and other objects, features, and advantages of the non-limiting exemplary embodiment(s) are provided by the reversible uni-hinge including a hinge assembly having a fulcrum axis passing through a longitudinal length thereof, a static first channel operably coupled to the hinge assembly, and a dynamic second channel operably coupled to the hinge assembly. Notably, the hinge assembly is connected to an exterior side of each of the static first channel and the dynamic second channel in such a manner that the dynamic second channel linearly reciprocates along the fulcrum axis as well as rotates in clockwise and counter clockwise directions about the fulcrum axis.

In a non-limiting exemplary embodiment, the hinge assembly includes a first hinge section statically coupled to the static first channel, a second hinge section statically coupled to the dynamic second channel, and a hinge pin spaced from the static first channel and the channel and longitudinally aligned with the fulcrum axis. Notably, the hinge pin linearly passes through the first hinge section and the second hinge section thereby permitting the dynamic second channel to articulate and linearly reciprocate relative to the static first channel.

In a non-limiting exemplary embodiment, the hinge assembly further includes a gravity cam including a pintle bushing mated to the first hinge section, and a cam bushing mated to the second hinge section. In this manner, the pintle bushing is in operable communication with the cam bushing when the hinge pin is positioned through the first hinge section and the second hinge section.

In a non-limiting exemplary embodiment, the first hinge section includes a first bracket statically affixed to the exterior side of the static first channel, an upper first conduit statically mated to a medial edge of the first bracket, and a lower first conduit statically mated to the medial edge of the first bracket and axially aligned subjacent to the upper first conduit. In this manner, the pintle bushing is seated in the lower first conduit.

In a non-limiting exemplary embodiment, the second hinge section includes a second bracket statically affixed to the exterior side of the dynamic second channel, and a second conduit statically mated to a medial edge of the second bracket. In this manner, the cam bushing is seated in the second conduit.

In a non-limiting exemplary embodiment, the second conduit is intermediately and axially aligned between the upper first conduit and the lower first conduit. Notably, the hinge pin is linearly inserted through the upper first conduit and the second conduit and terminates within the lower first conduit such that the hinge pin is in communication with each of the cam bushing and the pintle bushing.

In a non-limiting exemplary embodiment, the hinge assembly further includes a gap disposed between the upper first conduit and the second conduit such that the second conduit linearly reciprocates along the hinge pin as the second hinge section rises and falls during rotation of the dynamic second channel relative to the static first channel.

In a non-limiting exemplary embodiment, the lower first conduit includes an inner wall having a plurality of grooves formed therein. Notably, the pintle bushing includes a bushing housing including an outer wall having a spline extending outwardly therefrom. Such splines are selectively interfitted with corresponding ones of the a plurality of grooves such that the first hinge section is aligned with the second hinge section when the static first channel is angularly offset from the dynamic second channel.

In a non-limiting exemplary embodiment, the pintle bushing includes a bushing housing including an inner wall having a plurality of grooves formed therein, and a pintle insert including an outer wall having a spline extending outwardly therefrom. Such splines are selectively interfitted with corresponding ones of the plurality of grooves such that the first hinge section is aligned with the second hinge section when the static first channel is angularly offset from the dynamic second channel.

In a non-limiting exemplary embodiment, the second conduit includes an inner wall having a plurality of grooves formed therein. Notably, the cam bushing includes a cam housing including an outer wall having a spline extending outwardly therefrom. Such splines are selectively interfitted with corresponding ones of the plurality of grooves such that the second hinge section is aligned with the first hinge section when the dynamic second channel is angularly offset from the static first channel.

In a non-limiting exemplary embodiment, the cam bushing includes a cam housing including an inner wall having a plurality of grooves formed therein, and a cam insert including an outer wall having a spline extending outwardly therefrom. Such splines are selectively interfitted with corresponding ones of the plurality of grooves such that the second hinge section is aligned with the first hinge section when the dynamic second channel is angularly offset from the static first channel.

In a non-limiting exemplary embodiment, the static first channel has a first closed side and a first open side oppositely disposed therefrom.

In a non-limiting exemplary embodiment, the dynamic second channel has a second closed side and a second open side oppositely disposed therefrom.

In a non-limiting exemplary embodiment, when the channels are oriented at an equilibrium position, the first open side is oppositely registered from the second open side.

In a non-limiting exemplary embodiment, when the channels are oriented at an equilibrium position, the first closed side is juxtaposed adjacent to the second open side and registered parallel thereto.

The present disclosure further includes a method of utilizing a reversible un-hinge for pivotally connecting an existing toilet door partition to an existing pilaster. Such a method includes the steps of: providing a hinge assembly having a fulcrum axis passing through a longitudinal length thereof; providing a static first channel and a dynamic second channel; and operably coupling each of the static first channel and the dynamic second channel to the hinge assembly by connecting the hinge assembly to an exterior side of each the static first channel and the dynamic second channel, such that the dynamic second channel linearly reciprocates along the fulcrum axis as well as rotates in clockwise and counter clockwise directions about the fulcrum axis.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
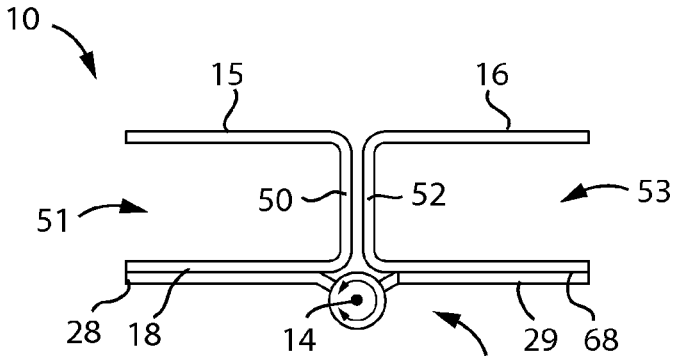
FIG. 1 is a top plan view of a reversible uni-hinge for pivotally connecting an existing toilet door partition to an existing pilaster, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

Figure 2:
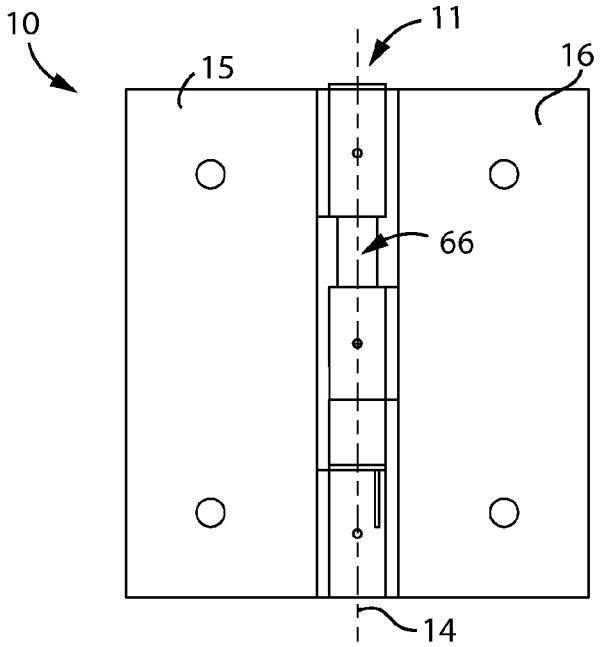
FIG. 2 is a front elevational view of the uni-hinge shown in FIG. 1.
Figure 3:
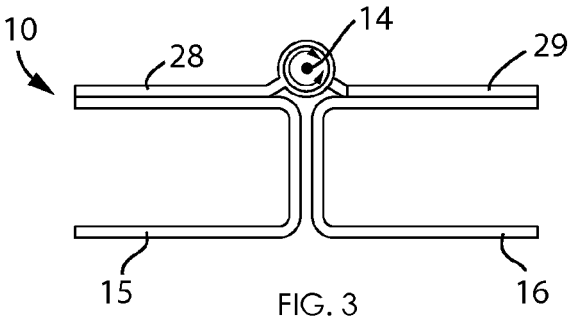
FIG. 3 is a bottom plan view of the uni-hinge shown in FIG. 1.
Figure 4:
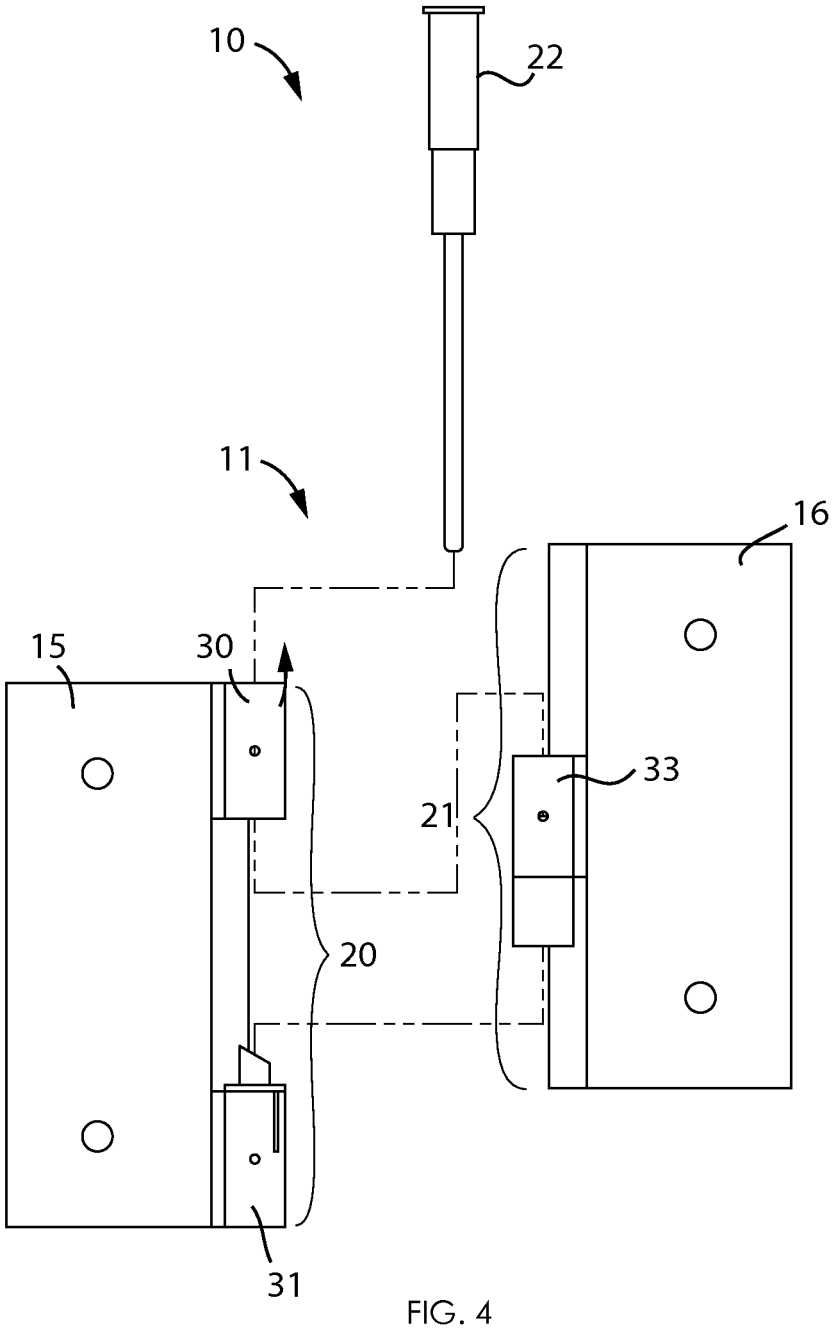
FIG. 4 is a partially exploded view of the uni-hinge shown in FIG. 2.
Figure 5:
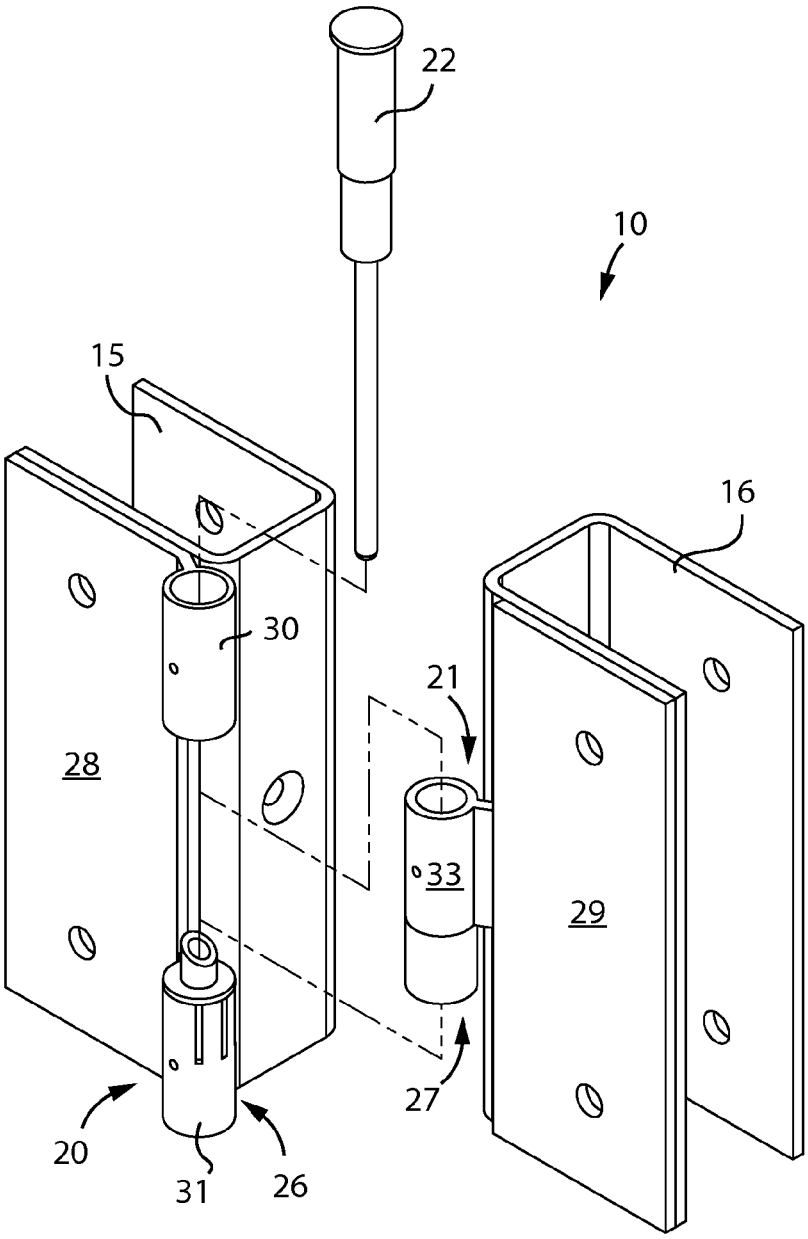
FIG. 5 is a perspective view of the uni-hinge shown in FIG. 4.
Figure 6:
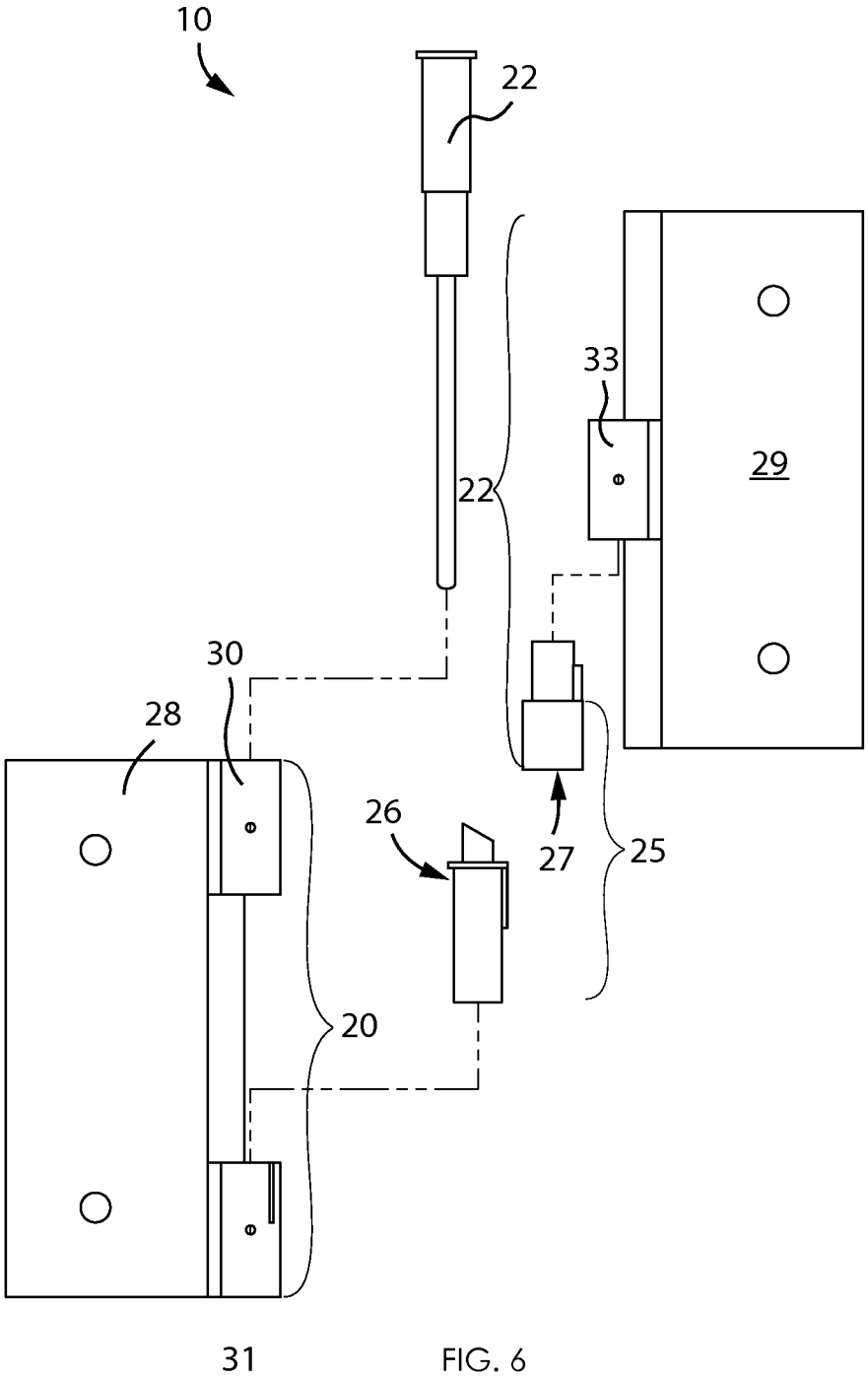
FIG. 6 is an exploded view showing the pintle bushing and cam bushing removed from the first hinge section and second hinge section, respectively.
Figure 7:
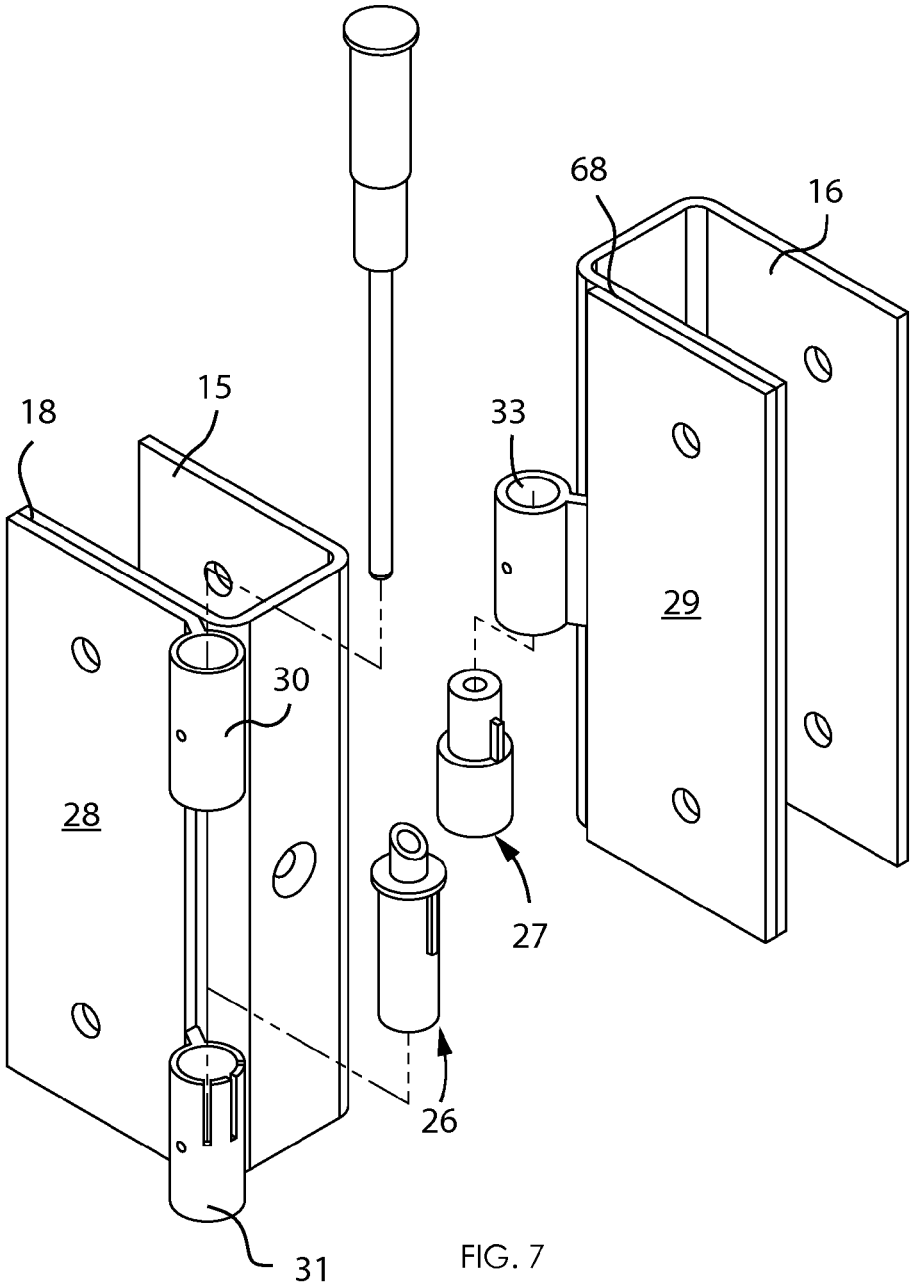
FIG. 7 is a perspective view of the uni-hinge shown in FIG. 7.
Figure 8:
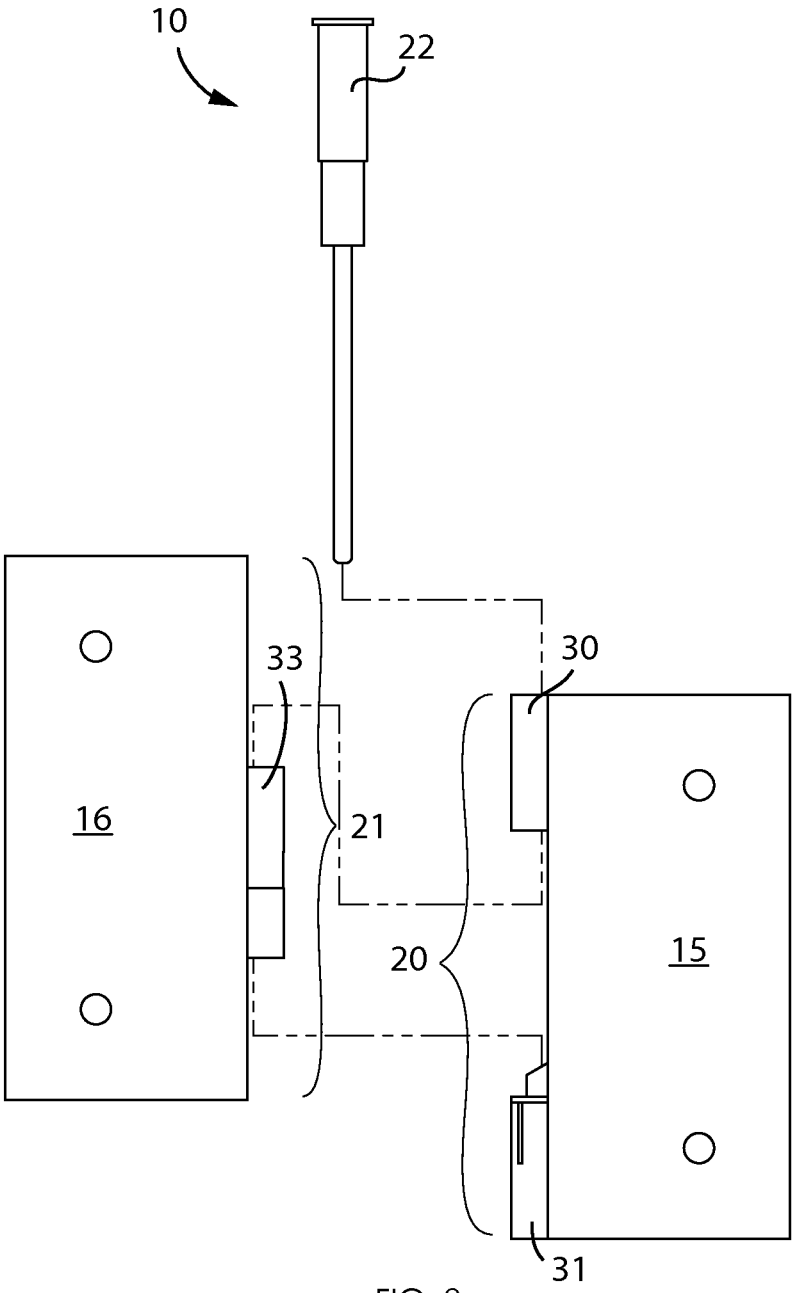
FIG. 8 is a rear elevational view of the uni-hinge shown in FIG. 4.
Figure 9:
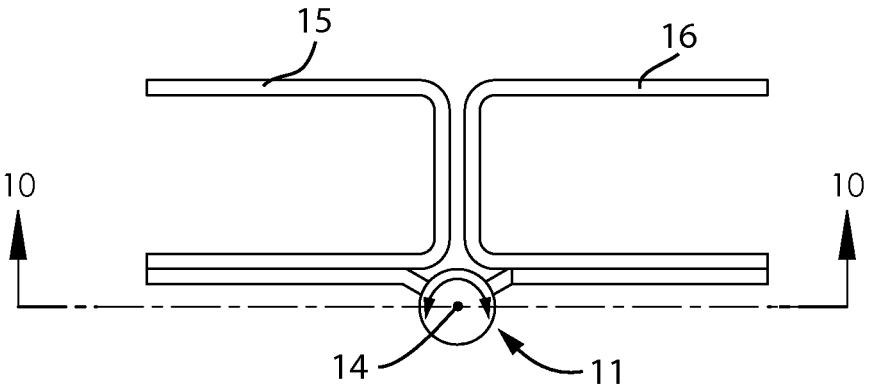
FIG. 9 is an enlarged top plane view of the uni-hinge shown in FIG. 2.
Figure 10:
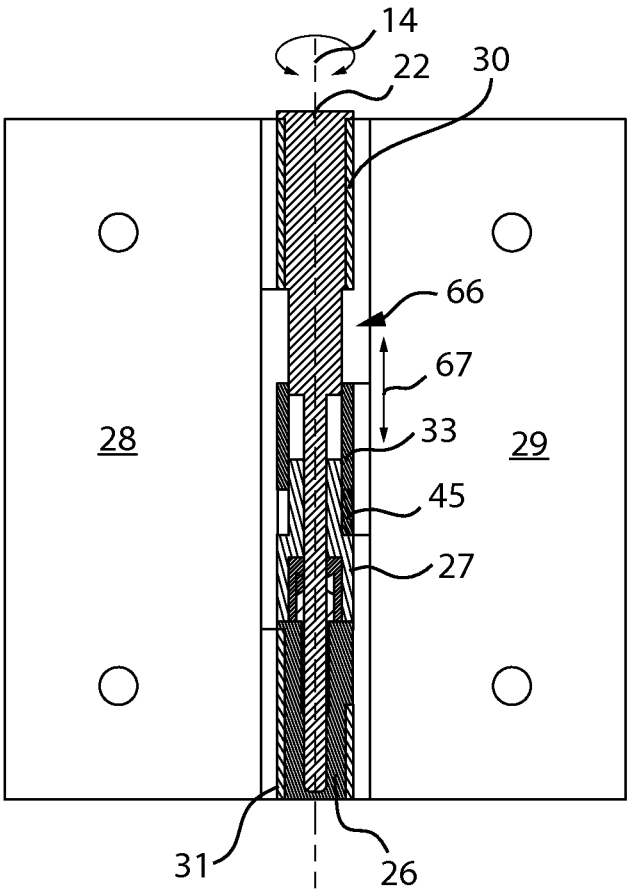
FIG. 10 is a cross-sectional view taken along line 10-10 in FIG. 9.
Figure 11:
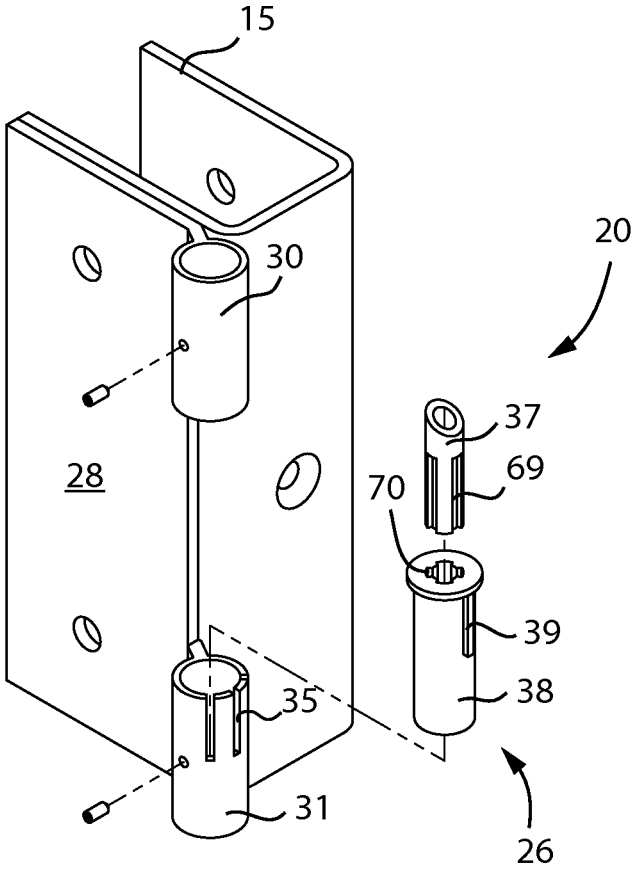
FIG. 11 is an exploded view of the first hinge section shown in FIG. 7.
Figure 12:
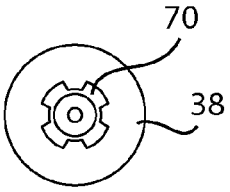
FIG. 12 is an enlarged top plan view of the pintle bushing housing shown in FIG. 11.
Figure 13:
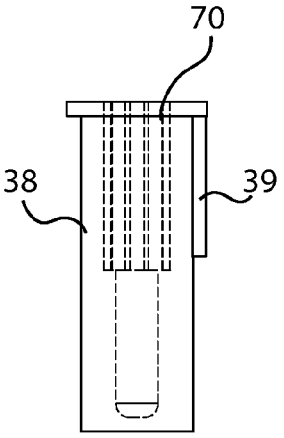
FIG. 13 is a side elevational view of the pintle bushing housing shown in FIG. 12.
Figure 14:
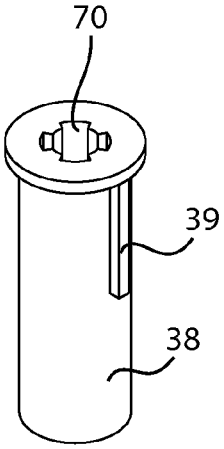
FIG. 14 is a perspective view of the pintle bushing housing shown in FIG. 13.
Figure 15:
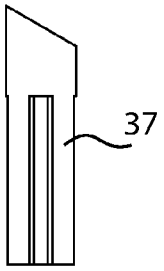
FIG. 15 is an enlarged side elevational view of the pintle insert showing in FIG. 11.
Figure 16:
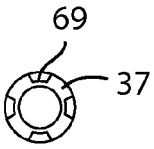
FIG. 16 is a top plan view of the pintle insert shown in FIG. 15.
Figure 17:
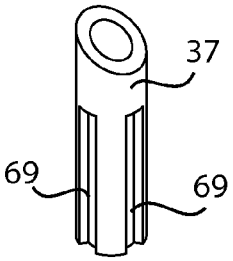
FIG. 17 is a perspective view of the pintle insert shown in FIG. 15.
Figure 18:
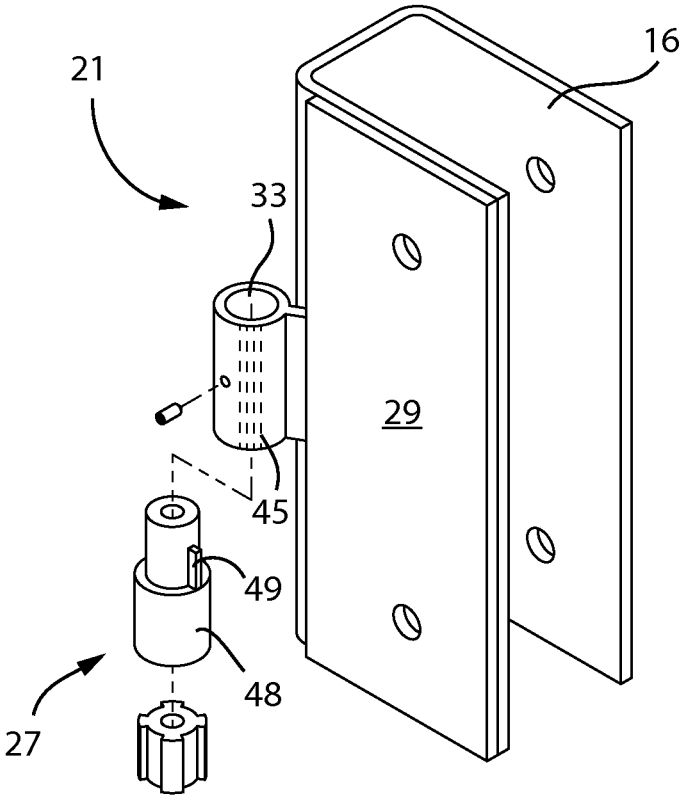
FIG. 18 is an exploded view of the second hinge section shown in FIG. 7.
Figure 19:
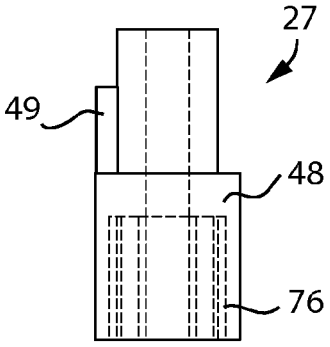
FIG. 19 is an enlarged side elevational view of the cam bushing housing shown in FIG. 18.
Figure 20:
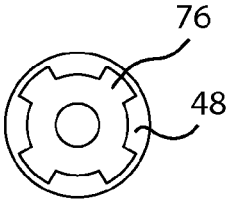
FIG. 20 is an enlarged bottom plan view of the cam bushing housing shown in FIG. 19.
Figure 21:
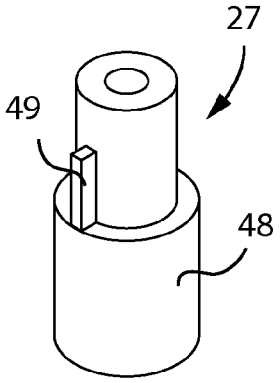
FIG. 21 is a perspective view of the cam bushing housing shown in FIG. 20.
Figure 22:
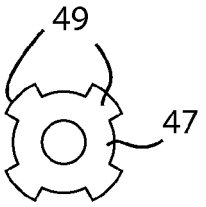
FIG. 22 is an enlarged top plan view of the cam insert showing in FIG. 7.
Figure 23:
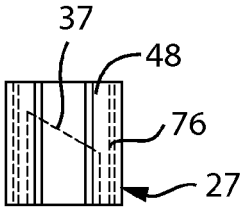
FIG. 23 is a side elevational view of the cam insert shown in FIG. 22.
Figure 24:
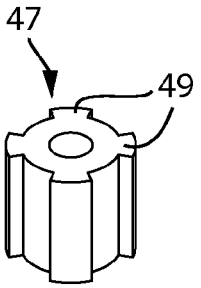
FIG. 24 is a perspective view of the cam insert shown in FIG. 23.
Figure 25:
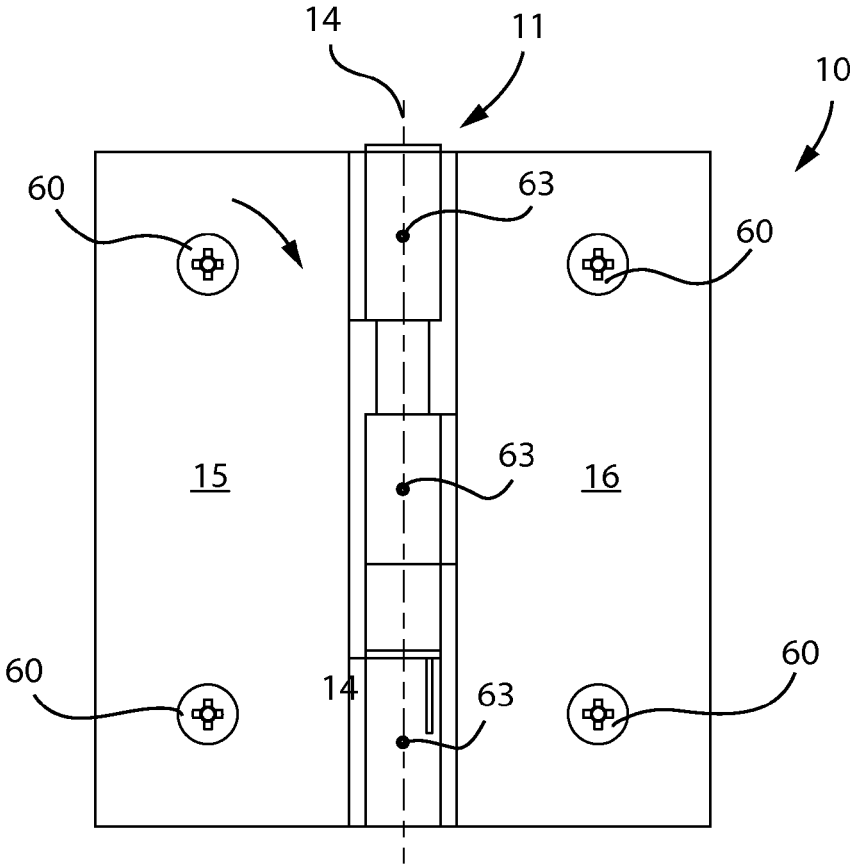
FIG. 25 is a front elevational view of a reversible uni-hinge for pivotally connecting an existing toilet door partition to an existing pilaster, in accordance with another non-limiting exemplary embodiment.
Figure 26:
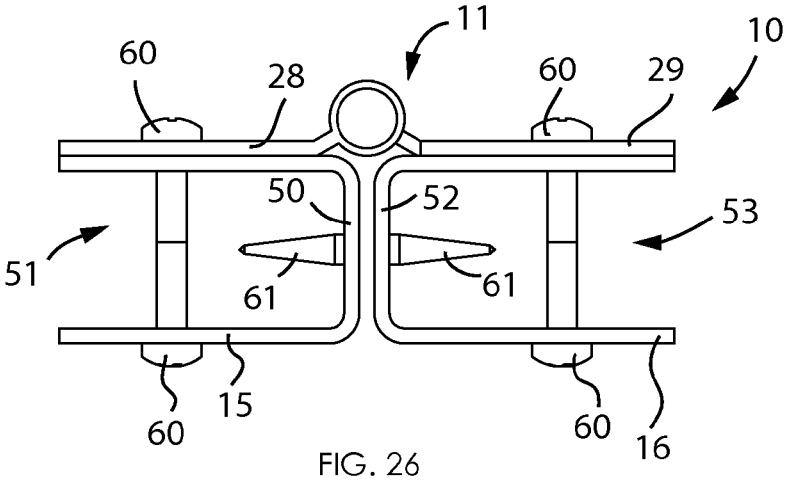
FIG. 26 is bottom plan view of the uni-hinge shown in FIG. 25.
Figure 27:
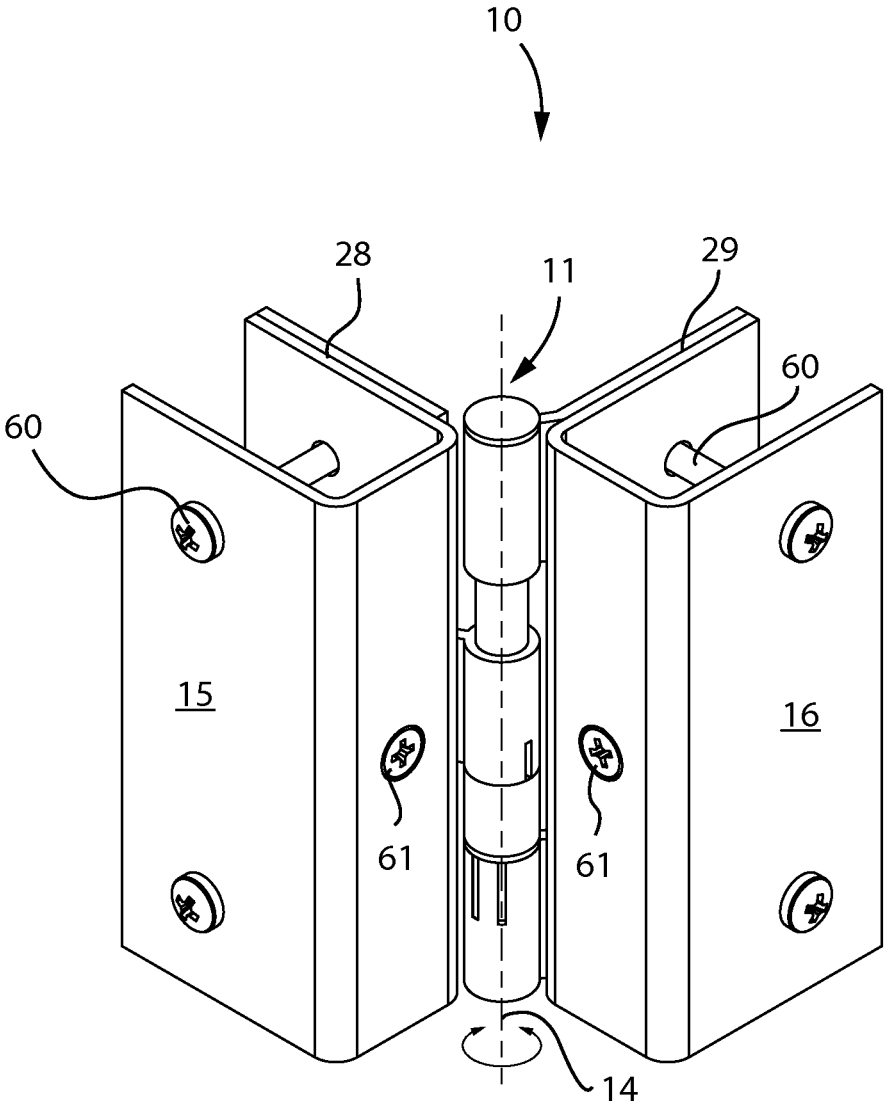
FIG. 27 is a perspective view of the uni-hinge shown in FIG. 25 wherein the second channel rotated relative to the first channel.
Figure 28:
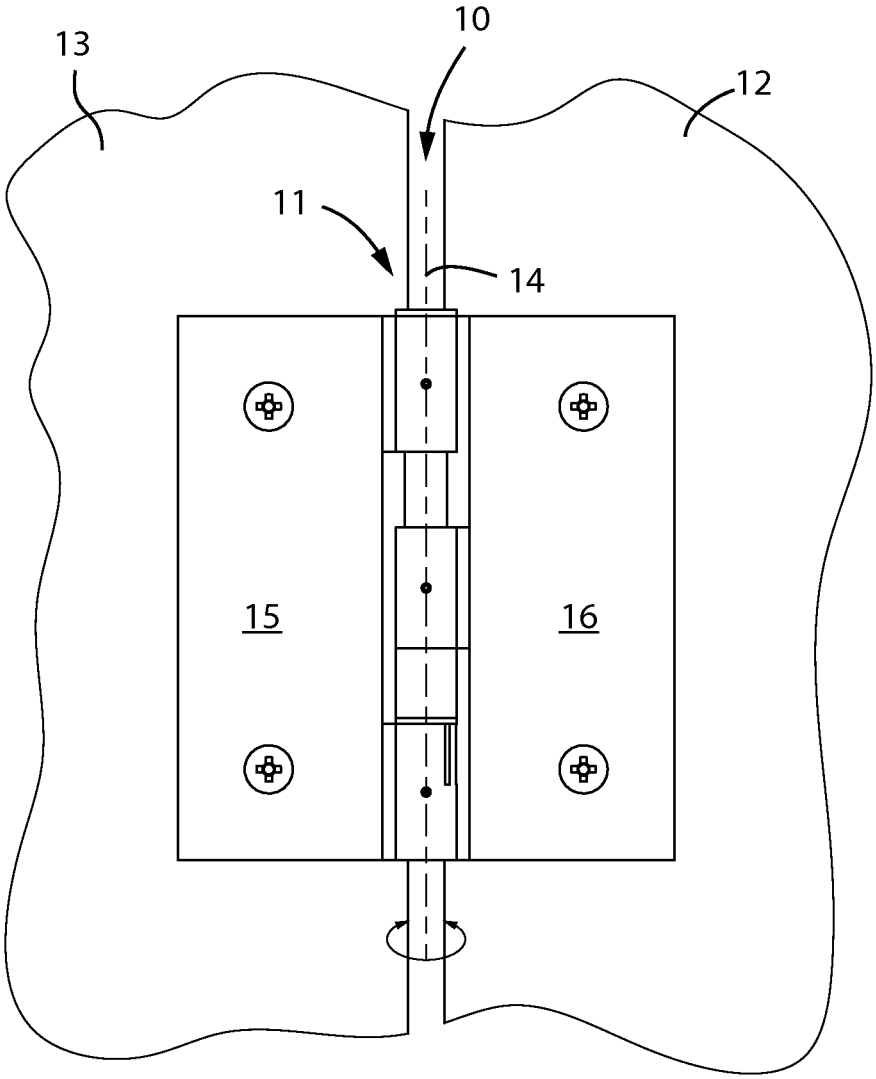
FIG. 28 is a front elevational view of the uni-hinge shown in FIG. 25 wherein the first channel is attached to an existing pilaster and the second channel is attached to a partition door.

The non-limiting exemplary embodiment(s) is/are referred to generally in FIGS. 1-28 and is/are intended to provide a reversible uni-hinge 10 for pivotally connecting an existing toilet door partition 12 to an existing pilaster 13. Such a reversible uni-hinge 10 includes a hinge assembly 11 having a fulcrum axis 14 passing through a longitudinal length thereof, a static first channel 15 operably coupled to the hinge assembly 11, and a dynamic second channel 16 operably coupled to the hinge assembly 11. Notably, the hinge assembly 11 is connected to an exterior side 18, 68 of each of the static first channel 15 and the dynamic second channel 16 in such a manner that the dynamic second channel 16 linearly reciprocates along the fulcrum axis 14 as well as rotates in clockwise and counter clockwise directions about the fulcrum axis 14.

In a non-limiting exemplary embodiment, the hinge assembly 11 includes a first hinge section 20 statically coupled to the static first channel 15, a second hinge section 21 statically coupled to the dynamic second channel 16, and a hinge pin 22 spaced from the static first channel 15 and the dynamic second channel 16 and longitudinally aligned with the fulcrum axis 14. Notably, the hinge pin 22 linearly passes through the first hinge section 20 and the second hinge section 21 thereby permitting the dynamic second channel 16 to articulate and linearly reciprocate relative to the static first channel 15.

In a non-limiting exemplary embodiment, the hinge assembly 11 further includes a gravity cam 25 including a pintle bushing 26 mated to the first hinge section 20, and a cam bushing 27 mated to the second hinge section 21. In this manner, the pintle bushing 26 is in operable communication with the cam bushing 27 when the hinge pin 22 is positioned through the first hinge section 20 and the second hinge section 21.

In a non-limiting exemplary embodiment, the first hinge section 20 includes a first bracket 28 statically affixed to the exterior side 18 of the static first channel 15, an upper first conduit 30 statically mated to a medial edge of the first bracket 28, and a lower first conduit 31 statically mated to the medial edge of the first bracket 28 and axially aligned subjacent to the upper first conduit 30. In this manner, the pintle bushing 26 is seated in the lower first conduit 31.

In a non-limiting exemplary embodiment, the second hinge section 21 includes a second bracket 29 statically affixed to the exterior side 58 of the dynamic second channel 16, and a second conduit 33 statically mated to a medial edge of the second bracket 29. In this manner, the cam bushing 27 is seated in the second conduit 33.

In a non-limiting exemplary embodiment, the second conduit 33 is intermediately and axially aligned between the upper first conduit 30 and the lower first conduit 31. Notably, the hinge pin 22 is linearly inserted through the upper first conduit 30 and the second conduit 33 and terminates within the lower first conduit 31 such that the hinge pin 22 is in communication with each of the cam bushing 27 and the pintle bushing 26.

In a non-limiting exemplary embodiment, the hinge assembly 11 further includes a gap 66 disposed between the upper first conduit 30 and the second conduit 33 such that the second conduit 33 linearly reciprocates 67 along the hinge pin 22 as the second hinge section 21 rises and falls during rotation of the dynamic second channel 16 relative to the static first channel 15.

In a non-limiting exemplary embodiment, the lower first conduit 31 includes an inner wall having a plurality of grooves 35 formed therein. Notably, the pintle bushing 26 includes a bushing housing 38 including an outer wall having a spline 39 extending outwardly therefrom. Such spline 39 is selectively interfitted with a corresponding one of the a plurality of grooves 35 such that the first hinge section 20 is aligned with the second hinge section 21 when the static first channel 15 is angularly offset from the dynamic second channel 16.

In a non-limiting exemplary embodiment, the pintle bushing 26 includes a bushing housing 38 including an inner wall having a plurality of grooves 70 formed therein, and a pintle insert 37 including an outer wall having splines 69 extending outwardly therefrom. Such splines 69 are selectively interfitted with corresponding ones of the plurality of grooves 70 such that the first hinge section 20 is aligned with the second hinge section 21 when the static first channel 15 is angularly offset from the dynamic second channel 16.

In a non-limiting exemplary embodiment, the second conduit 33 includes an inner wall having a plurality of grooves 45 formed therein. Notably, the cam bushing 27 includes a cam housing 48 including an outer wall having a spline 49 extending outwardly therefrom. Such a spline 49 is selectively interfitted with a corresponding one of the plurality of grooves 45 such that the second hinge section 21 is aligned with the first hinge section 20 when the dynamic second channel 16 is angularly offset from the static first channel 15.

In a non-limiting exemplary embodiment, the cam bushing 27 includes a cam housing 48 including an inner wall having a plurality of grooves 76 formed therein, and a cam insert 47 including an outer wall having splines 49 extending outwardly therefrom. Such splines 49 are selectively interfitted with corresponding ones of the plurality of grooves 76 such that the second hinge section 21 is aligned with the first hinge section 20 when the dynamic second channel 16 is angularly offset from the static first channel 15.

In a non-limiting exemplary embodiment, the static first channel 15 has a first closed side 50 and a first open side 51 oppositely disposed therefrom.

In a non-limiting exemplary embodiment, the dynamic second channel 16 has a second closed side 52 and a second open side 53 oppositely disposed therefrom.

In a non-limiting exemplary embodiment, when the channels 15, 16 are oriented at an equilibrium position, the first open side 51 is oppositely registered from the second open side 52.

In a non-limiting exemplary embodiment, when the channels 15, 16 are oriented at an equilibrium position, the first closed side 51 is juxtaposed adjacent to the second open side 52 and registered parallel thereto.

The present disclosure further includes a method of utilizing a reversible un-hinge 10 for pivotally connecting an existing toilet door partition 12 to an existing pilaster 13. Such a method includes the steps of: providing a hinge assembly 11 having a fulcrum axis 14 passing through a longitudinal length thereof; providing a static first channel 15 and a dynamic second channel 16; and operably coupling each of the static first channel 15 and the dynamic second channel 16 to the hinge assembly 11 by connecting the hinge assembly 11 to an exterior side 18 of each the static first channel 15 and the dynamic second channel 16, such that the dynamic second channel 16 linearly reciprocates along the fulcrum axis 14 as well as rotates in clockwise and counter clockwise directions about the fulcrum axis 14.

A non-limiting exemplary embodiment of the present disclosure is referred to generally in the FIGS. 1-28 and is intended to provide a reversible uni-hinge 10 including a gravity cam 25 that is used to pivotally connect a toilet door partition 12 to an existing pilaster 13. It should be understood that the exemplary embodiment may be used to pivotal mate a toilet door hinge to many different types of existing pilasters 13 and should not be limited to any particular toilet door pilaster 13 described herein.

In a non-limiting exemplary embodiment, the multi-functional hinge 10 includes a gravity cam 25 that is used to pivotally connect a toilet door partition 12 to an existing pilaster 13. The uni-hinge 10 has generally U-shaped wrap-around channels 15, 16 that are attached to three sides of the toilet door partition 12 and three sides of the pilaster 13, respectively. A surface mounted knuckle hinge assembly 11 is securely coupled to the wrap-around channels 15, 16. Such wrap-around channels 15, 16 may be coextensively shaped wherein a first one of the wrap-around channels 15 is attached to the pilaster 13 and a second one of wrap-around channels 16 is attached to the toilet door partition 12.

A pivoting mechanism 11 (hinge assembly) 11 adjustably mates the first and second wrap-around channels 15, 16 together. The pivoting mechanism 11 includes a plurality of bracket segments (conduits) statically affixed to the wrap-around channels 15, 16, respectively. A pintle bushing 26 is seated inside a corresponding bracket segment attached to the first wrap-channel 15 and a cam bushing 27 is seated inside a corresponding bracket segment attached to the second wrap-around channel 16. A hinge pin 22 is linearly inserted through the bracket segments and engages both the pintle bushing 26 and cam bushing 27. Notably, the hinge pin 22 steps down to fill in space as the toilet partition 12 door rises and lowers during articulation relative to the stationary pilaster 13.

Each of the pintle and cam bushings 26, 27 includes a tongue (spline) attached to an outer surface thereof, respectively. Corresponding grooves are formed in the bracket segments (conduits). In this manner, the tongues interlock with the grooves when the pintle and cam bushings 26, 27 are inserted in the corresponding bracket segments. Such a structural configuration permits the first and second wrap-around channels 15, 16 to become selectively oriented at alternate angles (clockwise and counter clockwise) relative to the pivoting mechanism 11. Of course, multiple tongues and grooves may be employed to permit desired orientation of the first and second wrap-around channels 15, 16 relative to each other. Fasteners 60, 61 may be positioned through the first and second wrap-around channels 15, 16 to securely engage the pilaster 13 and toilet door partition 12 thereto, respectively. Fasteners 63 may be engaged with the hinge assembly 11 for additional support.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A reversible uni-hinge for pivotally connecting an existing toilet door partition to an existing pilaster, said reversible uni-hinge comprising:

a hinge assembly having a fulcrum axis passing through a longitudinal length thereof;

a static first channel operably coupled to said hinge assembly; and a dynamic second channel operably coupled to said hinge assembly;

wherein said hinge assembly is connected to an exterior side of each said static first channel and said dynamic second channel in such a manner that said dynamic second channel linearly reciprocates along said fulcrum axis as well as rotates in clockwise and counter clockwise directions about said fulcrum axis;

wherein said hinge assembly comprises a first hinge section statically coupled to said static first channel, a second hinge section statically coupled to said dynamic second channel, and a hinge pin spaced from said static first channel and said dynamic second channel and longitudinally aligned with said fulcrum axis;

wherein said hinge pin linearly passes through said first hinge section and said second hinge section thereby permitting said dynamic second channel to articulate and linearly reciprocate relative to said static first channel;

wherein said hinge assembly further comprises a gravity cam including a pintle bushing mated to said first hinge section, and a cam bushing mated to said second hinge section;

wherein said pintle bushing is in operable communication with said cam bushing when said hinge pin is positioned through said first hinge section and said second hinge section;

wherein said first hinge section comprises a first bracket statically affixed to said exterior side of said static first channel, an upper first conduit statically mated to a medial edge of said first bracket, and a lower first conduit statically mated to said medial edge of said first bracket and axially aligned subjacent to said upper first conduit;

wherein said pintle bushing is seated in said lower first conduit;

wherein said second hinge section comprises a second bracket statically affixed to said exterior side of said dynamic second channel, and a second conduit statically mated to a medial edge of said second bracket;

wherein said cam bushing is seated in said second conduit;

wherein said second conduit is intermediately and axially aligned between said upper first conduit and said lower first conduit;

wherein said hinge pin is linearly inserted through said upper first conduit and said second conduit and terminates within said lower first conduit such that said hinge pin is in communication with each of said cam bushing and said pintle bushing;

wherein said pintle bushing comprises a bushing housing including an inner wall having a plurality of grooves formed therein, and a pintle insert including an outer wall having a spline extending outwardly therefrom, said spline being selectively interfitted with corresponding ones of said plurality of grooves such that said first hinge section is aligned with said second hinge section when said static first channel is angularly offset from said dynamic second channel.

2. The reversible uni-hinge of claim 1, wherein said hinge assembly further comprises:

a gap disposed between said upper first conduit and said second conduit such that said second conduit linearly reciprocates along said hinge pin as said second hinge section rises and falls during rotation of said dynamic second channel relative to said static first channel.

3. The reversible uni-hinge of claim 2, wherein said second conduit includes an inner wall having a plurality of grooves formed therein; wherein said cam bushing comprises:

a cam housing including an outer wall having a spline extending outwardly therefrom, said spline being selectively interfitted with corresponding ones of said plurality of grooves such that said second hinge section is aligned with said first hinge section when said dynamic second channel is angularly offset from said static first channel.

4. The reversible uni-hinge of claim 1, wherein said lower first conduit includes an inner wall having a plurality of grooves formed therein; wherein said pintle bushing comprises:

a bushing housing including an outer wall having a spline extending outwardly therefrom, said spline being selectively interfitted with corresponding ones of said a plurality of grooves such that said first hinge section is aligned with said second hinge section when said static first channel is angularly offset from said dynamic second channel.

5. A reversible uni-hinge for pivotally connecting an existing toilet door partition to an existing pilaster, said reversible uni-hinge comprising:

a hinge assembly having a fulcrum axis passing through a longitudinal length thereof;

a static first channel operably coupled to said hinge assembly; and a dynamic second channel operably coupled to said hinge assembly;

wherein said hinge assembly is connected to an exterior side of each said static first channel and said dynamic second channel in such a manner that said dynamic second channel linearly reciprocates along said fulcrum axis as well as rotates in clockwise and counter clockwise directions about said fulcrum axis;

wherein said hinge assembly comprises a first hinge section statically coupled to said static first channel, a second hinge section statically coupled to said dynamic second channel, and a hinge pin spaced from said static first channel and said dynamic second channel and longitudinally aligned with said fulcrum axis;

wherein said hinge pin linearly passes through said first hinge section and said second hinge section thereby permitting said dynamic second channel to articulate and linearly reciprocate relative to said static first channel;

wherein said hinge assembly further comprises: a gravity cam including a pintle bushing mated to said first hinge section, and a cam bushing mated to said second hinge section;

wherein said pintle bushing is in operable communication with said cam bushing when said hinge pin is positioned through said first hinge section and said second hinge section;

wherein said first hinge section comprises a first bracket statically affixed to said exterior side of said static first channel, an upper first conduit statically mated to a medial edge of said first bracket, and a lower first conduit statically mated to said medial edge of said first bracket and axially aligned subjacent to said upper first conduit;

wherein said pintle bushing is seated in said lower first conduit;

wherein said second hinge section comprises a second bracket statically affixed to said exterior side of said dynamic second channel, and a second conduit statically mated to a medial edge of said second bracket;

wherein said cam bushing is seated in said second conduit;

wherein said hinge assembly further comprises a gap disposed between said upper first conduit and said second conduit such that said second conduit linearly reciprocates along said hinge pin as said second hinge section rises and falls during rotation of said dynamic second channel relative to said static first channel;

wherein said cam bushing comprises a cam housing including an inner wall having a plurality of grooves formed therein, and a cam insert including an outer wall having a spline extending outwardly therefrom, said spline being selectively interfitted with corresponding ones of said plurality of grooves such that said second hinge section is aligned with said first hinge section when said dynamic second channel is angularly offset from said static first channel.

* * * * *